US007769136B2

(12) United States Patent
Baumann

(10) Patent No.: US 7,769,136 B2
(45) Date of Patent: Aug. 3, 2010

(54) APPARATUS AND METHOD FOR POSITIONING AN X-RAY LENS AND X-RAY DEVICE INCORPORATING SAID APPARATUS

(75) Inventor: Thomas Baumann, Munster (DE)

(73) Assignee: Unisantis Fze, Dubai (AE)

( * ) Notice: Subject to any disclaimer, the term of this patent is extended or adjusted under 35 U.S.C. 154(b) by 92 days.

(21) Appl. No.: 12/064,387

(22) PCT Filed: Aug. 17, 2006

(86) PCT No.: PCT/EP2006/008142

§ 371 (c)(1),
(2), (4) Date: Jul. 31, 2008

(87) PCT Pub. No.: WO2007/022917

PCT Pub. Date: Mar. 1, 2007

(65) Prior Publication Data

US 2009/0220054 A1 Sep. 3, 2009

(30) Foreign Application Priority Data

Aug. 22, 2005 (EP) ..... 05018216

(51) Int. Cl.
*G21K 1/06* (2006.01)

(52) U.S. Cl. ..... 378/84; 378/205

(58) Field of Classification Search ..... 378/84, 378/85, 145, 205

See application file for complete search history.

(56) References Cited

U.S. PATENT DOCUMENTS

| | | | | |
|---|---|---|---|---|
| 4,940,319 | A * | 7/1990 | Ueda et al. | 378/84 |
| 5,192,869 | A * | 3/1993 | Kumakhov | 378/145 |
| 6,504,901 | B1 | 1/2003 | Loxley et al. | |
| 6,539,075 | B1 * | 3/2003 | Tamura | 378/45 |
| 2004/0013236 | A1 * | 1/2004 | Papaioannou et al. | 378/147 |
| 2004/0042584 | A1 * | 3/2004 | Blank et al. | 378/81 |
| 2005/0053197 | A1 | 3/2005 | Radley et al. | |

OTHER PUBLICATIONS

International Search Report of PCT/EP2006/008142, date of mailing Nov. 16, 2006.

* cited by examiner

*Primary Examiner*—Chih-Cheng G Kao
(74) *Attorney, Agent, or Firm*—Westerman, Hattori, Daniels & Adrian, LLP

(57) ABSTRACT

A positioning technique for aligning an X-ray lens (28) is described. A positioning apparatus (16) comprises a lens mounting component (44) and a positioning component (42). The positioning component (42) includes at least one goniometer stage (64, 66) having a center of rotation that substantially coincides with the X-ray emitting portion (36) ("hot spot") of the X-ray source (12). The provision of one or more goniometer stages (64, 66) and, if required, one or more additional translation stages (60, 62) facilitates the adjustment of the X-ray lens (28) and makes the adjustment more intuitive.

19 Claims, 4 Drawing Sheets

APPARATUS AND METHOD FOR POSITIONING AN X-RAY LENS AND X-RAY DEVICE INCORPORATING SAID APPARATUS

FIELD OF THE INVENTION

The present invention relates to a positioning apparatus and a positioning method for an X-ray lens (also called "Kumakhov lens"). The invention further relates to an X-ray device such as an X-ray spectrometer or an X-ray diffractometer comprising an X-ray lens and a positioning apparatus for the X-ray lens.

BACKGROUND OF THE INVENTION

The advent of so-called X-ray lenses over two decades ago has prepared the ground for lightweight, portable X-ray devices with a broad spectrum of applications in areas as different as metallurgy, geology, chemistry, forensic laboratories and customs inspection. In a similar way as conventional optical lenses redirect visible or near-visible photons, X-ray lenses redirect electromagnetic radiation in the X-ray radiation band and may thus be used to collimate or focus a beam of X-rays.

An X-ray lens is conventionally formed from a plurality of capillaries. Each capillary guides the X-rays captured at a front end thereof to the opposite end by way of total external reflection. This rule applies so long as the angle of incidence at the front end does not exceed a critical angle. If the critical angle is exceeded, X-rays can no longer be captured within the capillary. In such a case, the capillary becomes transparent to the X-rays.

Originally, an X-ray lens was a bulky device with dimensions in the region of up to several meters. These large dimensions were mainly the result of separate support structures that were required to keep the individual capillaries in place. Commercial use of X-ray lenses became feasible when it was recognized that the support structures can be omitted if the X-ray lens is produced out of one or more glass capillary bundles using glass drawing techniques. By fusing the capillary mantles together, separate support structures became obsolete.

Today, the commercial application of X-ray lenses includes portable X-ray spectrometers, lightweight X-ray diffractometers and many other small-sized devices. Such devices typically comprise an X-ray source (such as an X-ray tube), an X-ray lens and a detector. X-rays emitted from the X-ray source are focused by the X-ray lens onto a tiny spot on a sample. The detector detects the X-rays emitted back from the sample and generates an output signal that can for example be spectrally analysed to determine the chemical elements included in the sample.

To enhance the efficiency of an X-ray device, the X-ray lens must be precisely aligned with respect to an axis of the X-ray device. If the X-ray lens is not correctly aligned, the flux of X-rays captured by the X-ray lens can get drastically reduced as a result of the fact that the angle of incidence exceeds the critical angle for too many X-rays.

In the past, the alignment of X-ray lenses was a cumbersome task even for very experienced operators. With conventional positioning mechanisms, the adjustment in one direction often involved a simultaneous (mis-)adjustment in another direction. These dependencies prevented an intuitive alignment of an X-ray lens and required many individual adjustment steps.

Accordingly, there is a need for a positioning apparatus and a positioning method that facilitate the adjustment of an X-ray lens. Also, there is a need for an X-ray device including a positioning apparatus for an X-ray lens.

SUMMARY OF THE INVENTION

According to a first aspect of the invention, a positioning apparatus for aligning an X-ray lens is provided. The positioning apparatus comprises a lens mounting component and a positioning component including at least one goniometer stage, the least one goniometer stage having a centre of rotation that substantially coincides with an X-ray emitting portion of an X-ray source.

In a goniometer stage, the centre of rotation is outside the goniometer mechanic. In the present case, the centre of rotation is chosen to essentially coincide with the X-ray emitting portion of the X-ray source. Typically, the goniometer mechanic comprises a curved guidance structure. With the centre point of the curvature being "in the air" and at least close to the X-ray emitting portion, everything mounted on the goniometer stage (such as the X-ray lens) rotates around the X-ray emitting portion. This approach facilitates lens alignment.

In one example, the positioning component includes a first goniometer stage for tilting the X-ray lens about a first axis and a second goniometer stage for tilting the X-ray lens about a second axis. The second axis may run perpendicular to the first axis. The first axis and the second axis may be chosen such that they intersect each other at a point that approximately coincides with the X-ray emitting portion of the X-ray source.

The two goniometer stages may be arranged one behind the other in relation to the X-ray source. With such an arrangement, the first goniometer stage may have a first distance from the X-ray emitting portion, and the second goniometer stage may have a second distance from the X-ray emitting portion that is different from the first distance. Accordingly, the two goniometer stages may have different radii with respect to the point of intersection between the first tilting axis and the second tilting axis.

In one variation, the first goniometer stage is actuable independently from the second goniometer stage. In other words, the first tilting axis may be decoupled from the second tilting axis. To this end, separate actuation mechanisms for the first goniometer stage and the second goniometer stage may be provided.

According to a first variant of the invention, the X-rays generated by the X-ray source pass the positioning component outside the at least one goniometer stage. According to a second variant, the at least one goniometer stage has an internal X-ray passage. The internal X-ray passage may extend through the centre of the at least one goniometer stage. Alternatively, the internal X-ray passage may have an eccentric extension in relation to the centre of the at least one goniometer stage.

In addition to the at least one goniometer stage, the positioning component may further comprise one, two or more translation stages. In one example, the positioning means comprises a first translation stage having a first axis of translation and a second translation stage having a second axis of translation. The second axis of translation may run obliquely or, preferably, in perpendicular to the first axis of translation. The first translation axis and the second translation axis are preferably arranged in a plane that intersects a longitudinal axis of the X-ray lens at approximately a right angle.

In addition to the first and second translation stages, a third translation stage having a third axis of translation may be provided. The third translation axis may extend perpendicularly in relation to the first and second translation axis.

Like the goniometer stages, the translation stages may be arranged one behind the other. In the direction of the X-rays emitted from X-ray source, the one or two translation stages may be arranged upstream or downstream of the one or two goniometer stages.

The first translation stage and the second translation stage may each be provided with a separate actuation mechanism and may thus be actuable independently from each other (and also independently from the at least one goniometer stage). Accordingly, all the individual positioning axes of the positioning apparatus may be decoupled. In one possible scenario, this decoupling means that a translation along a first axis is independent of the tilting about a second axis perpendicular to the first axis (including all permutated variants).

The positioning apparatus may further comprise a first interface member for coupling the positioning apparatus to a housing of the X-ray source. Additionally, or in the alternative, the positioning apparatus may comprise a second interface member for coupling the positioning apparatus to a sample housing.

The positioning apparatus may comprise an X-ray shielding component that may be provided at an end of the positioning apparatus to face the X-ray source. The shielding component is preferably configured to define a limited X-ray passage and to block all X-rays outside the X-ray passage. The provision of an X-ray shielding means permits to manufacture the positioning apparatus from a material (such as a aluminum) that is essentially transparent to X-rays.

In a variation, the positioning apparatus also comprises an X-ray lens. The X-ray lens may extend centrally through the positioning apparatus and may be aligned with or define the X-ray passages mentioned above. The X-ray lens may have various shapes and configurations. In one embodiment, the X-ray lens comprises one or more bundles of capillaries.

The lens mounting component allows for a coupling between the position component and the lens to be positioned. In one example, the less mounting component is configured to generate a clamping force acting on either the lens or any structural member rigidly attached to the lens.

According to a further aspect of the invention, an X-ray device is provided. The X-ray device comprises an X-ray source having an X-ray emitting portion, an X-ray lens for redirecting X-rays emitted from the X-ray source, and a positioning apparatus for aligning the X-ray lens, the positioning apparatus comprising at least one goniometer stage having a centre of rotation that substantially coincides with the X-ray emitting portion.

The X-ray device may further comprise an X-ray shielding component arranged between the X-ray source and the at least one goniometer stage. The X-ray shielding component preferably restricts the X-ray beam emitted from the X-ray source to an X-ray passage that is defined by or aligned with the X-ray lens.

According a still further aspect of the invention, a method of aligning an X-ray lens using a positioning apparatus including at least one translation stage and at least one goniometer stage with a centre of rotation that substantially coincides with an X-ray emitting portion of an X-ray source is provided. The positioning method comprises the steps of positioning an inlet focus of the X-ray lens by actuating the at least one translation stage (preferably by individually actuating the first and second translation stages) to substantially coincide with the X-ray emitting portion, and by actuating the at least one goniometer stage to align the X-ray lens in relation to a predefined axis extending through the X-ray emitting portion (such as an optical axis of any device incorporating the positioning apparatus).

BRIEF DESCRIPTION OF THE DRAWINGS

Further aspects, advantages and variations of the invention will become apparent from the following description of a preferred embodiment and from the drawings.

DESCRIPTION OF A PREFERRED EMBODIMENT

In the following, the invention will exemplarily be described with reference to a preferred embodiment in the form of an X-ray spectrometer comprising a positioning apparatus with two goniometer stages and two translation stages. It should be noted that the invention can also be practised in other X-ray devices such as diffractometers and in positioning apparatuses having a different structure (e.g. including no, only one or three translation stages).

Figure 1:
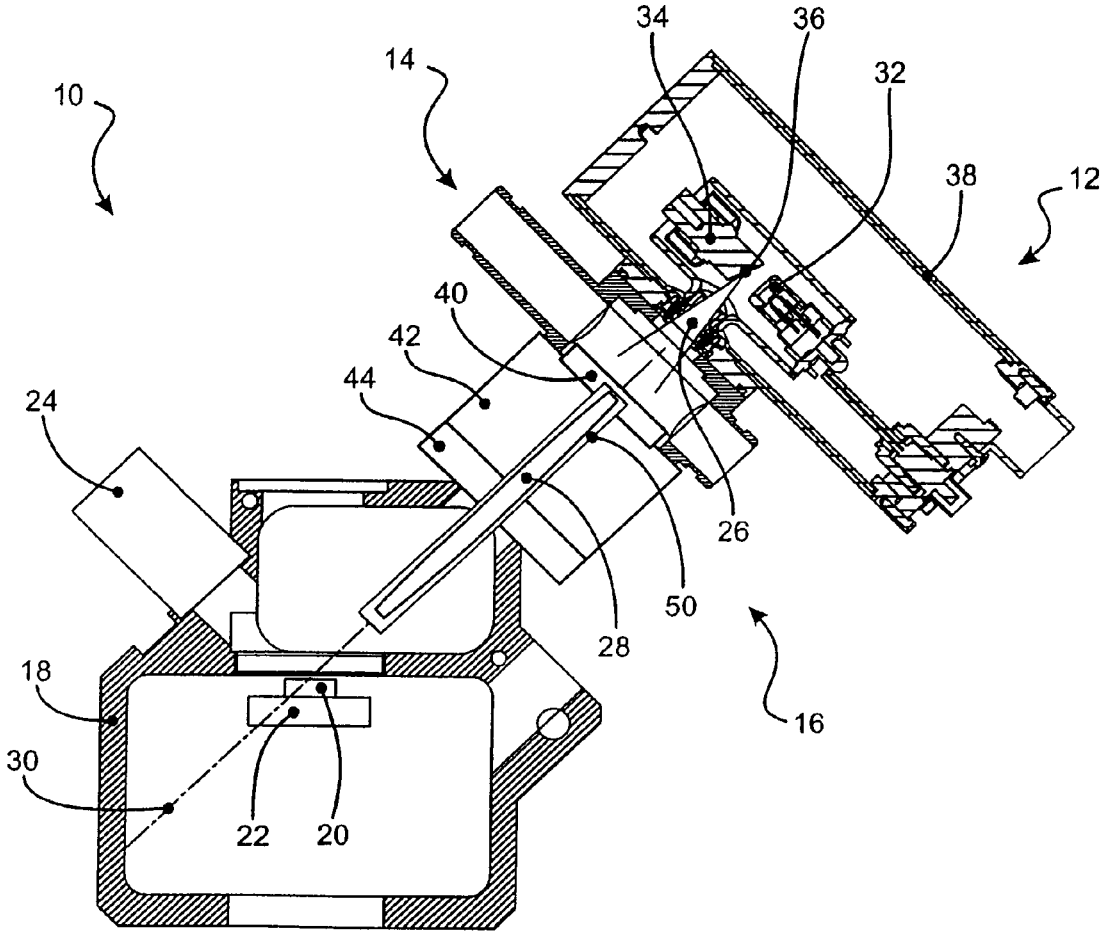
FIG. 1 shows a cross sectional view of an X-ray spectrometer embodiment of the present invention.

FIG. 1 shows a cross sectional view of an X-ray spectrometer 10 according to an embodiment of the present invention. The spectrometer 10 includes an X-ray source 12 constituted by an X-ray tube. The spectrometer 10 further comprises a shutter 14, a modular positioning apparatus 16, a sample housing 18 with a sample 20 arranged on a sample positioning platform 22, and a detector 24.

An X-ray beam generated within the X-ray source 12 and indicated by reference numeral 26 passes along an optical axis 30 through the shutter 14. An X-ray (or Kumakhov) lens 28 to be aligned by means of the positioning apparatus 16 in relation to the X-ray source 12 and in relation to the optical axis 30 focuses the X-ray beam onto a tiny spot on the sample 20 (note that the size of the sample 20 is exaggerated in the schematic drawing of FIG. 1). The detector 24 collects the X-rays emitted back from the sample 20 and outputs a spectrum signal indicative of the chemical elements included in the sample 20.

The spectrometer 10 shown in FIG. 1 has a compact tabletop design and is transportable for in-situ analysis. The samples may be provided in a wide range of physical forms, including solids, powders, pressed pellets, liquids, granules, films and coatings. The typical element detection capabilities of the spectrometer 10 under atmospheric conditions range from aluminum (Al) to uranium (U). The spectrometer 10 allows for a qualitative and quantitative elemental analysis down to very low elemental concentrations and sample sizes of 20 μm.

In the view of FIG. 1, the X-ray source 12 and the shutter 14 have been rotated by 90° about the optical axis 30 of the spectrometer 10 to better illustrate their structure. Like conventional X-ray tubes, the X-ray source 12 includes a cathode 32 to emit electrons and an anode 34 to collect the electrons emitted by the cathode 32. Thus, a flow of electrical current is established as the result of a high voltage connected across the cathode 32 and the anode 34. The electron flow within the X-ray source 12 is focused onto a very small spot (the "hot spot") 36 on the anode 34. The anode 34 is precisely angled at typically 5 to 15 degrees off perpendicular to the electron current so as to allow the escape of some of the X-rays generated at the "hot spot" 36 upon annihilation of the kinetic energy of the electrons colliding with the anode 34. The X-ray beam 26 thus generated is emitted from the "hot spot" 36 essentially perpendicular to the direction of the electron current and essentially along the optical axis 30 at diverging angles.

The X-rays emitted from the X-ray source 12 first pass the shutter 14 attached to a housing 38 of the X-ray source 12. The shutter 14 selectively blocks the X-ray beam 26 generated within the X-ray source 12 and thus provides a control mechanism for selectively switching the irradiation of the sample 20 "on" or "off".

The lens positioning apparatus 16 is arranged downstream (in relation to X-ray source 12) of the shutter 14 and is rigidly attached to the shutter 14 by means of an interface member (not shown in FIG. 1). The positioning apparatus 16 includes an X-ray shielding component 40, a positioning component 42 for the X-ray lens 28, and a lens mounting component 44 for rigidly coupling the X-ray lens 28 to the positioning component 42. The individual components 40, 42, 44, which are shown only schematically in FIG. 1, are illustrated in more detail in the various views of FIGS. 2 to 4.

Figure 2:
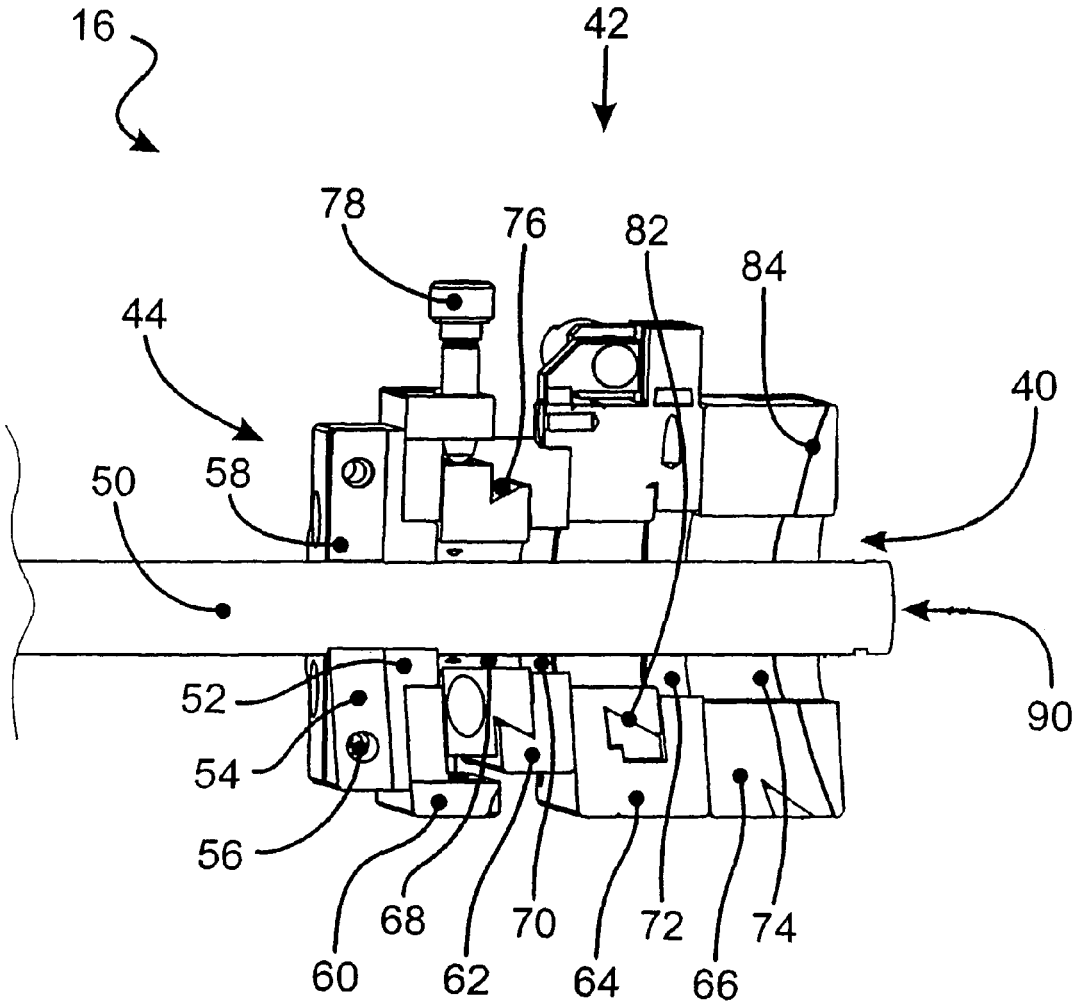
FIG. 2 shows a cross sectional view of a positioning apparatus included in the X-ray spectrometer of FIG. 1.
Figure 3:
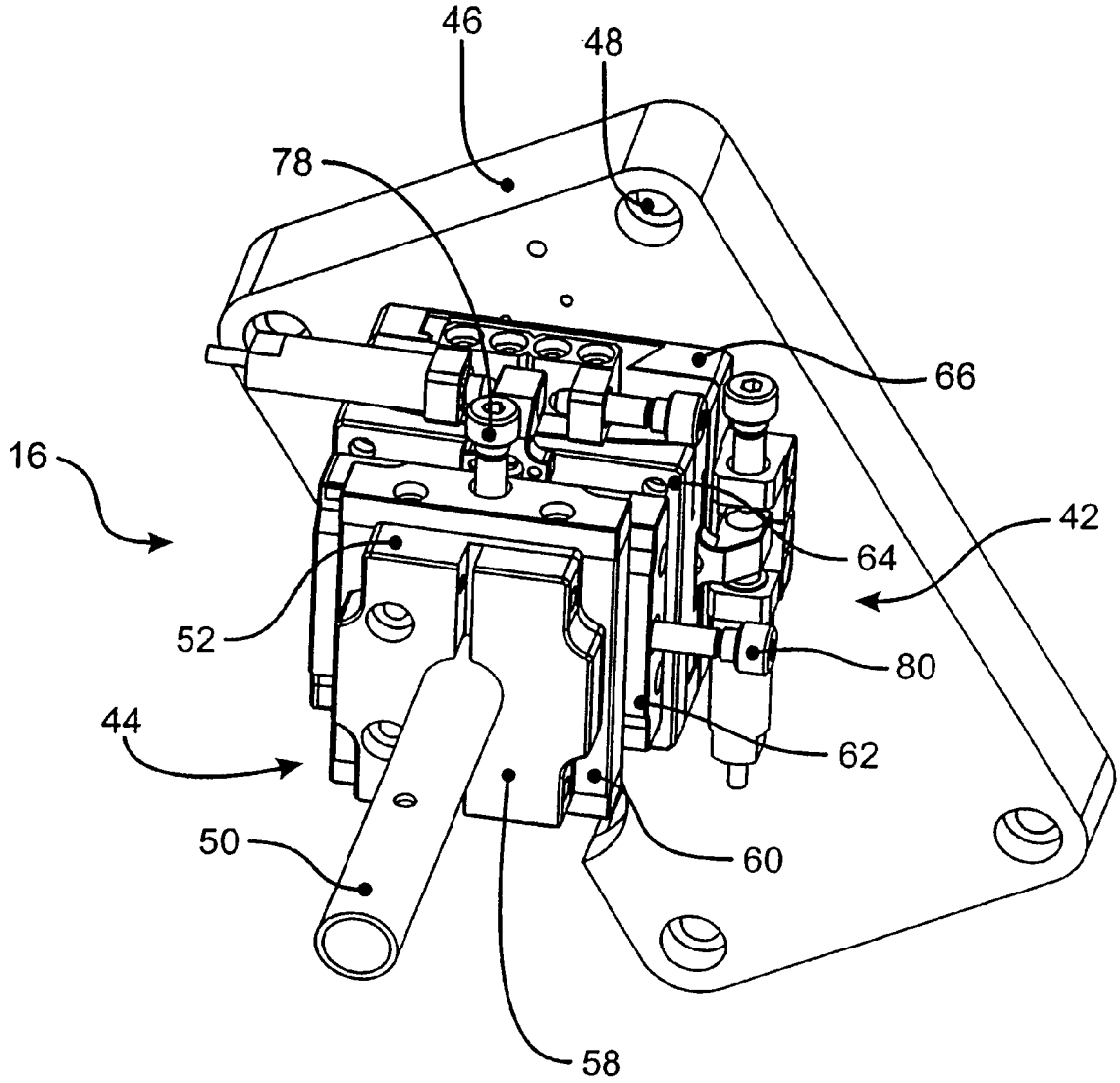
FIG. 3 shows a perspective view of the downstream end of the positioning apparatus of FIG. 2.
Figure 4:
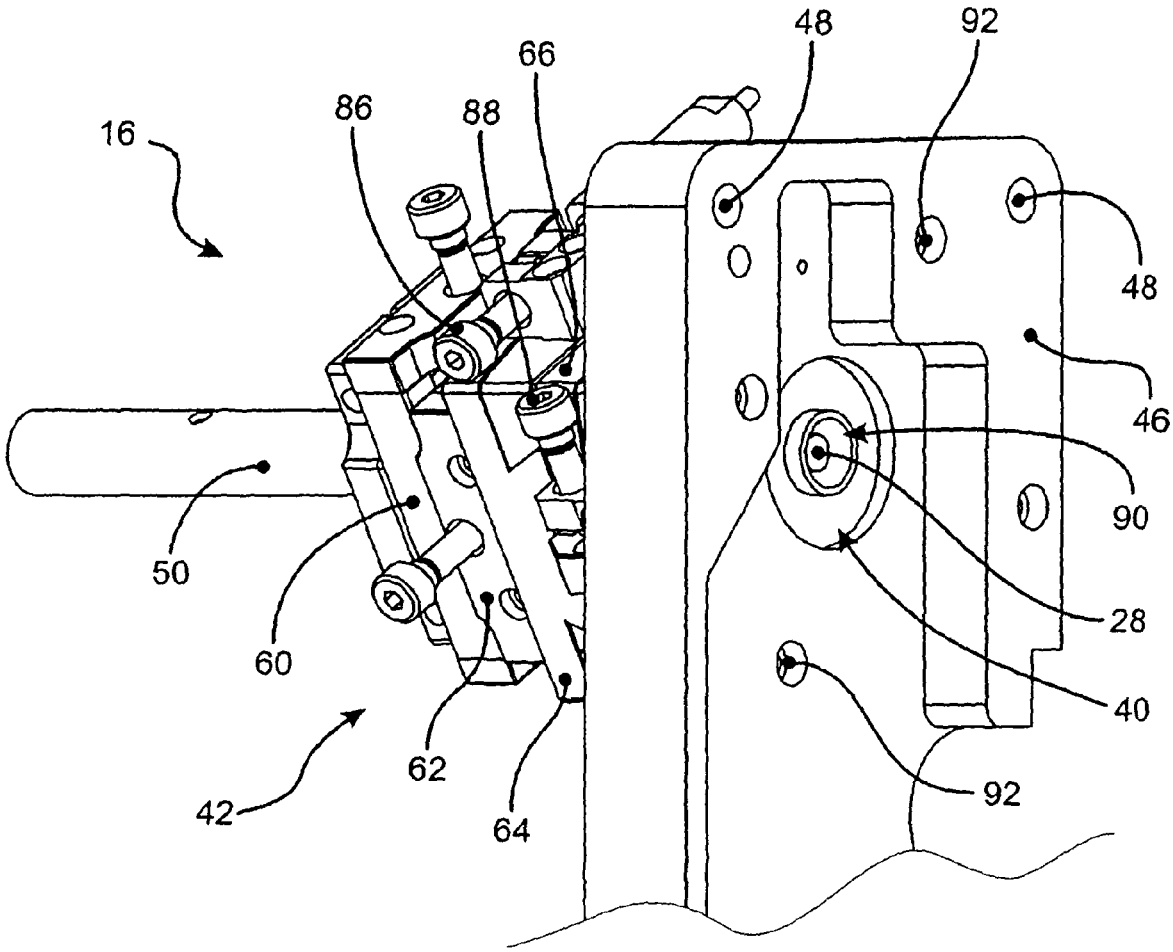
FIG. 4 shows a perspective view of the upstream end of the positioning apparatus of FIG. 2.

As becomes apparent from FIGS. 3 and 4, the X-ray shielding component 40 has an outer flange 46 (not shown in FIG. 2) with two screw holes 48 for rigidly attaching the whole positioning apparatus 16 to the shutter 14 (and thus to the X-ray source 12). The outer flange 46 therefore serves as an interface member of the positioning apparatus 16 in relation to the shutter 14/the X-ray source 12. The X-ray shielding component 40 may comprises further structural elements as required for limiting the X-ray beam essentially to an inlet opening of the X-ray lens 28.

The X-ray lens (not shown in FIGS. 2 to 4) is fixedly mounted inside a tube member 50. The tube member 50 in turn is rigidly coupled to the lens mounting component 44. The lens mounting component 44 comprises a base member 52 attached to the positioning component 42. The base member 52 has a central opening for receiving the tube member 50. A plurality of tongues 54 with outer threaded portions 56 extend from the opening of the base member 52 and in the axial direction of the tube member 50.

The lens mounting component 44 further comprises a collar member 58 with a central opening through which the tube member 50 extends. The collar member 58 can be screwed onto the tongues 54 and cooperates with their outer threaded portions 56. Be means of an additional screw (not shown) extending in perpendicular to the tube member 50 and through the collar member 58, the free end at least one of the tongues 54 can be moved towards the tubular member 50 as the screw is screwed into the collar member 58. Accordingly, a clamping connection between the tubular member 50 on the one hand and the lens mounting component 44 on the other hand is established.

The positioning component 42 is arranged upstream of the lens mounting component 44 and includes two translation stages 60, 62 as well as two goniometer stages 64, 66. As can be seen from FIG. 2, the base member 52 of the lens mounting means 44 is attached to the bottom of the first translation stage 60.

The individual positioning stages 60, 62, 64, 66 are arranged one behind the other. Starting with a first translation stage 60 as the most downstream positioning stage, a second translation stage 62, a first goniometer stage 64 and a second goniometer stage 66 as the most upstream positioning stage follow. Each of the positioning stages 60, 62, 64, 68 has a central X-ray passage 68, 70, 72, 74, respectively, through which the tubular member 50 extends.

Each of the two translation stages 60, 62 includes a double-dovetail guide (only one, reference numeral 76, is shown in the cross sectional view of FIG. 2). For each of the two translation stages 60, 62, a separate fine-pitch adjustment screw with an associated knob 78, 80 and spring returnment, respectively, is provided.

In combination, the first translation stage 60 and the second translation stage 62 form an xy translation stage. Accordingly, the first translation stage 60 has a first axis of translation, namely the x axis which in FIG. 2 runs perpendicular to the axis of the tubular member 50 and in parallel to the drawing plane. The second translation stage 62 has a second axis of translation, namely the y axis which runs perpendicular to the x axis and perpendicular to the axis of the tubular member 50. By means of the respective knobs 78, 80, the first and second translation stage 60, 62 can be actuated independently from each other. In an alternative embodiment not shown in the drawings, a third translation stage having a third axis of translation (z axis) that runs perpendicular to both the first and second axis of translation may be provided.

The two goniometer stages 64, 66 are arranged upstream of the two translation stages 60, 62. In their combination, the first goniometer stage 64 and the second goniometer stage 66 form a theta-phi goniometer that provides for two independent rotations about a common centre of rotation. This common centre of rotation is substantially constituted by the "hot spot" 36 shown in FIG. 1, i.e. by the X-ray emitting portion of the X-ray source 12.

Each goniometer stage 64, 66 includes a curved dovetail guide 82, 84, respectively, and can be adjusted by associated fine-pitch screws via knobs 86, 88 with spring returnment, respectively. The provision of two separate adjustment knobs 86, 88 allows for a separate actuation of each of the first and second goniometer stage 64, 66.

An actuation of the first goniometer stage 64 tilts the tube member 50 (with the X-ray lens) about a first tilting axis that runs through the "hot spot" 36 shown in FIG. 1 and in the drawing plane of FIG. 1 perpendicular to the optical axis 30. An actuation of the second goniometer stage 66 tilts the tube member 50 about a second tilting axis that also runs through the "hot spot" 36 and that is perpendicular to both the first tilting axis and the drawing plane of FIG. 1. Since the first goniometer stage 64 is arranged downstream of the second goniometer stage 66, the distance of a reference point on the first goniometer stage 64 to the "hot spot" 36 is larger than the distance between a corresponding reference point on the second goniometer stage 66 and the "hot spot" 36.

The tubular member 50 with the X-ray lens can be positioned in relation to a stack of four decoupled axes (two translation axes running perpendicular to each other and two tilting axes also running perpendicular to each other). Accordingly, a translational movement along any translational axis is independent from a tilting movement about any tilting axis and vice versa. This allows for an easier and more intuitive alignment of the X-ray lens received in the tubular member 50 in relation to the "hot spot" 36 on the anode 34 and in relation to the optical axis 30. The fact that the tubular member 50 with the X-ray lens extends centrally through the positioning module 16 (and centrally through the positioning apparatus 42) further facilitates the alignment procedure.

When the X-ray lens 28 shown in FIG. 1 is to be aligned in relation to the "hot spot" 36 of the X-ray source 12 and the optical axis 30, in a first step an inlet focus of the X-ray lens 28 is positioned in the xy plane such that the inlet focus essentially coincides with the "hot spot" 36. This first positioning step therefore only involves an actuation of the first and second translation stages 60, 62. In a second positioning step, the X-ray lens 28 is tilted and turned to align a longitudinal axis of the X-ray lens 28 such that it coincides with the optical axis 30. The second positioning step involves an adjustment of one or both of the first and second goniometer stages 64, 66. While the knobs 78, 80, 86, 88 shown in FIGS. 2 to 4 are intended for manual actuation, an alternative embodiment of the inventions provides for a motor actuation.

The X-ray shielding component 40 (only schematically shown in FIG. 1 and only partially shown in FIGS. 2 to 4) is attached at the bottom of the second translation stage 66 via screws extending through openings 92 in the flange portion 46. The shielding component 40 is advantageously configured to block all X-rays outside the circular X-ray passage defined by the upstream opening 90 of the tubular member 50 and thus efficiently shields the positioning component 42 from X-rays. Accordingly, the individual components of the positioning component 42 (such as the translation stages 60, 62 and the goniometer stages 64, 66) can without any X-ray safety problem be manufactured from conventional materials such as aluminium which generally are transparent or nearly transparent to X-rays.

While the current invention has been described with respect to a particular embodiment, those skilled in the art will recognize that the current invention is not limited to the specific embodiment described and illustrated herein. Therefore, it is to be understood that the present disclosure is only illustrative. It is intended that the invention be limited only by scope of the claims appended hereto.

The invention claimed is:

1. A positioning apparatus for aligning an X-ray lens, the apparatus comprising:

a positioning component having at least one goniometer stage, the at least one goniometer stage having a centre of rotation that substantially coincides with an X-ray emitting portion of an X-ray source; and a lens mounting component.

2. The positioning apparatus of claim 1, wherein a first goniometer stage is arranged for tilting the X-ray lens about a first axis, and wherein the apparatus further comprises a second goniometer stage for tilting the X-ray lens about a second axis that is substantially perpendicular to the first axis.

3. The positioning apparatus of claim 2, wherein the first goniometer stage is arranged at a first distance from the X-ray emitting portion and the second goniometer stage is positioned at a second distance from the X-ray emitting portion that is different from the first distance.

4. The positioning apparatus of claim 2, wherein the first goniometer stage can be actuated independently from the second goniometer stage.

5. The positioning apparatus of claim 1, wherein the at least one goniometer stage has an X-ray passage.

6. The positioning apparatus of claim 5, wherein the X-ray passage extends substantially through the centre of the at least one goniometer stage.

7. The positioning apparatus of claim 1, wherein the positioning component further comprises at least one translation stage.

8. The positioning apparatus of claim 7, wherein the positioning component comprises a first translation stage having a first axis of translation and a second translation stage having a second axis of translation that is substantially perpendicular to the first axis of translation.

9. The positioning apparatus of claim 7, wherein the at least one translation stage has an X-ray passage.

10. The positioning apparatus of claim 9, wherein the X-ray passage extends substantially through the centre of the at least one translation stage.

11. The positioning apparatus of claim 1, wherein the apparatus further comprises at least one interface member for coupling the positioning apparatus to at least one of a housing of the X-ray source and a sample housing.

12. The positioning apparatus of claim 1, wherein the apparatus further comprises an X-ray shielding component, provided at an end of the apparatus to face the X-ray source.

13. The positioning apparatus of claim 12, wherein the positioning component is at least partially made from a material that is essentially transparent to X-rays.

14. The positioning apparatus of claim 13, wherein the material is aluminium.

15. The positioning apparatus of claim 1, wherein the apparatus further comprises an X-ray lens extending substantially centrally through the positioning component.

16. An X-ray device, comprising an X-ray source having an X-ray emitting portion;

an X-ray lens for redirecting X-rays emitted from the X-ray source;

a positioning apparatus for aligning the X-ray lens, the positioning apparatus comprising at least one goniometer stage having a centre of rotation that substantially coincides with the X-ray emitting portion.

17. The X-ray device of claim 16, wherein the X-ray lens comprises one or more bundles of capillaries.

18. The X-ray device of claim 16, wherein the X-ray device further comprises an X-ray shielding component arranged between the X-ray source and the at least are goniometer stage.

19. A method of positioning an X-ray lens in relation to an X-ray emitting portion of an X-ray source, the X-ray lens being maneuverable by means of at least one translation stage and at least one goniometer stage, the at least one goniometer stage having a centre of rotation that substantially coincides with the X-ray emitting portion, the positioning method comprising the steps of a) manipulating the at least one translation stage to position an inlet focus of the X-ray lens to substantially coincide with the X-ray emitting portion; and b) manipulating the at least one goniometer stage after the manipulating step (a), wherein the at least one goniometer stage is manipulated to align an axis of the X-ray lens with a predetermined axis extending through the X-ray emitting portion.

* * * * *